US006041640A

United States Patent [19]

McInerney et al.

[11] Patent Number: 6,041,640

[45] Date of Patent: Mar. 28, 2000

[54] SPIRAL AND HYPOID TOOTH MEMBER AND METHOD AND DEVICE FOR FORMING THE SAME

[75] Inventors: Terrance M. McInerney; Robert J. Stevens, both of Columbus, Ind.

[73] Assignee: Impact Forge, Inc., Columbus, Ind.

[21] Appl. No.: 09/170,598

[22] Filed: Oct. 13, 1998

Related U.S. Application Data

[63] Continuation-in-part of application No. 08/893,932, Jul. 15, 1997, abandoned.

[51] Int. Cl.[7] ..... B21K 1/30

[52] U.S. Cl. ..... 72/344; 29/893.34

[58] Field of Search ..... 72/344, 345, 427; 29/893.34

[56] References Cited

U.S. PATENT DOCUMENTS 4,050,283 9/1977 Schober .

FOREIGN PATENT DOCUMENTS 0 581 483 1/1994 European Pat. Off. .

4-210839 7/1992 Japan .

*Primary Examiner*—Lowell A. Larson

*Attorney, Agent, or Firm*—Harness, Dickey & Pierce, P.L.C.

[57] ABSTRACT

A method and apparatus for ejecting a member from a die. The method includes the steps of rotating the member about its axis and axially displacing the member relative to the die. The ejector device includes an ejector having an axis and twisting means for rotating the ejector when the ejector is axially displaced. The invention further includes a formed member including a body being symmetric about an axis, a spiral protrusion extending from the body, and connecting means for rotationally coupling the body to an ejector device.

21 Claims, 4 Drawing Sheets

FIG 3A
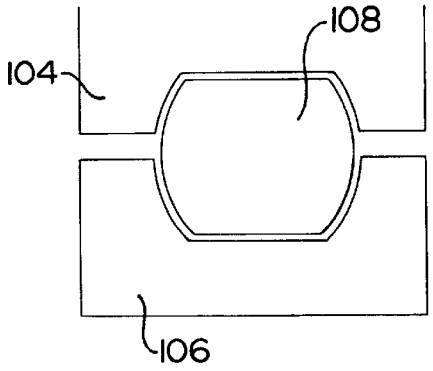
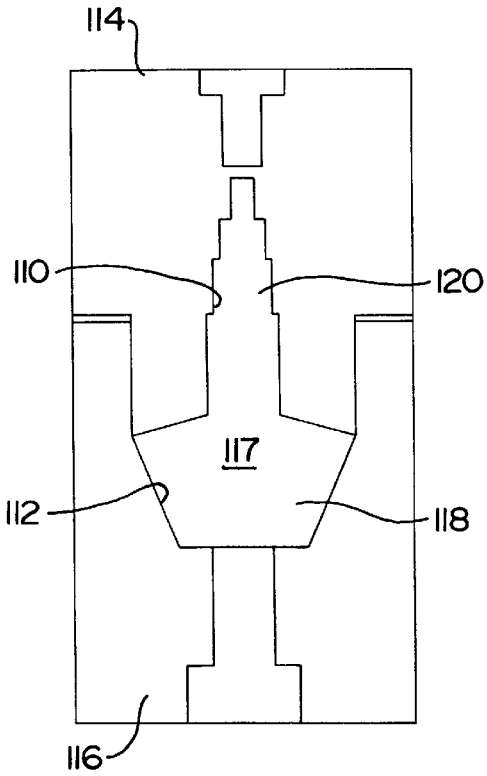
FIG 3B
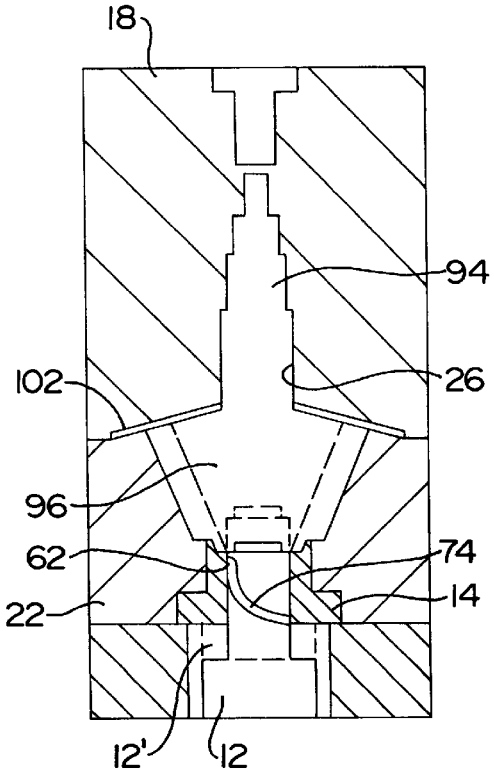
FIG 3C

FIG 4
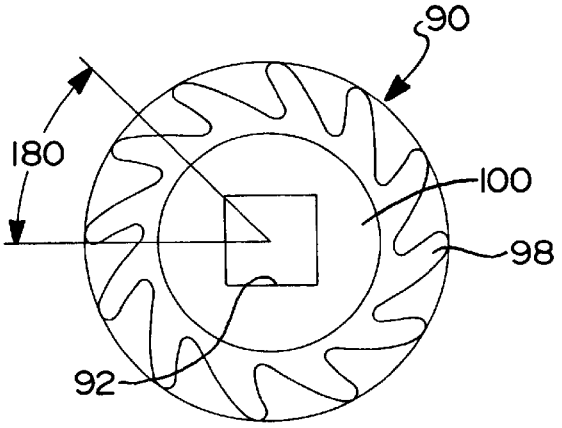
FIG 5D
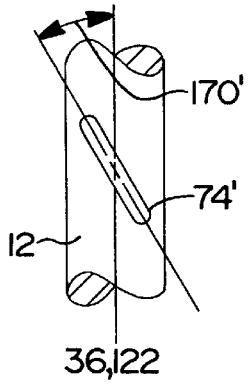
FIG 5C
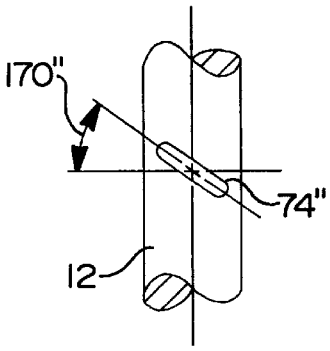
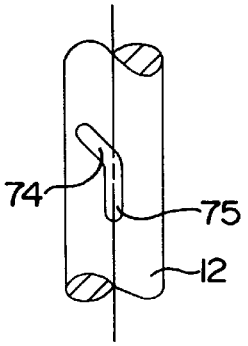
FIG 5B

SPIRAL AND HYPOID TOOTH MEMBER AND METHOD AND DEVICE FOR FORMING THE SAME

This is a continuation-in-part of U.S. patent application Ser. No. 08/893,932, filed Jul. 15, 1997, now abandoned.

BACKGROUND OF THE INVENTION

1. Technical Field

The present invention relates to a method and device for forming parts and, more particularly, to forming and ejecting net shaped and near net shaped parts with curved or spiral teeth.

2. Discussion

Commonly used techniques for forming members having spiral or otherwise curved projections do not adequately address the manufacturing difficulties and costs associated therewith. For example, a variety of gear configurations, including gears having spiral shaped teeth such as hypoid, spiral bevel, spiral spur, and helical gears, are used in a multitude of industries to translate mechanical movement of components through shafts formed integral with or otherwise connected to the gears. These and similar gears are commonly formed through multiple step forging and machining processes that gradually refine the gear form and the relatively precise dimensions of the gear teeth.

It should be noted that the manufacturing difficulties discussed herein are encountered during the manufacture of members other than gears as well as during forming processes other than forging. Moreover, the difficulties specifically related to forging are encountered during hot, warm, and cold forging of members having spiral or otherwise curved protruding projections. For simplicity, references in this application to "gears" also refer to any formed member having spiral or curved protrusions. In the interest of consistency and simplicity, the term "forging" is used to represent all recognized techniques for forming spiral toothed members including the above-mentioned cold, warm, and hot forging as well as other forming processes such as casting, powdered metal processing, and the like.

Commonly, the forging of a gear includes the selection of a predetermined volume of material, an initial preforming step such as descaling or breaking down the selected volume into a pancake, secondary preforming of the pancake into a forging blank of a selected configuration such as a cone, with or without a stem, and a finish forging step wherein the forging blank is formed into the general shape of the finished part either with or without partially or completely formed teeth protruding from the cone. The aforementioned steps are performed in a generally recognized manner through the use of a variety of dies. The forged gear without teeth or with the partially formed teeth is then machined to remove excess material and to complete the gear, and particularly the gear teeth, within required tolerances.

Commonly available forging and machining techniques used to manufacture gears with spiral teeth, such as those identified above, require a significant and costly amount of machining away of the space between the teeth of the spiral gear from the cone shaped forged blank. This large amount of machining results primarily from an inability to remove a spiral shaped gear with more completely forged teeth from the die without deforming the teeth. The present invention reduces the need for post-forming machining by more effectively ejecting the part from the die and without deforming the teeth.

Specifically, the standard technique for ejecting or "knocking out" a forged part from a die is to vertically displace the part relative to the die. However, when a part with spiral projections is ejected in this fashion the forged spiral teeth of the part tend to contact the projections in the die that define the teeth. Any such contact subjects the part and the tooth projections to an undesirable load that tends not only to inhibit removal of the part but also to deform the teeth thereby resulting in an inaccurate part.

The problems associated with tooth deformation increases with the severity of the tooth angles and is particularly troublesome for teeth having an angle relative to the body of greater than about ten (10°) degrees. Moreover, tooth deformation is more likely to occur for certain forming processes. For example, the ejector pressure, the pressure imparted on the teeth during ejection, generally causes greater deformation for hot and warm forged parts, e.g., parts forged at a temperature greater than about 1300° F., than for cold forged parts.

The present invention provides a method and device for removing a part having spiral projections from a die in a manner that prevents deformation of the projections as well as other undesirable consequences of contact between the part and die during ejection. In accordance with the present invention, ejection of the part from the die is accomplished by rotating the part in addition to the previously recognized method of axial displacement. Accordingly, the present invention overcomes the manufacturing process disadvantages associated with previously recognized methods for removing a part having spiral projections from a die. The present invention also realizes the above benefit while allowing the teeth to be more completely formed in the forging process thereby reducing the extent of the more expensive machining operation. Finally, by the present invention, a spirally toothed member may be formed through forging to achieve more consistent grain flow thereby providing a stronger member than those requiring more extensive machining.

SUMMARY OF THE INVENTION

In one embodiment of the present invention, a method for ejecting a member from a die is disclosed to include the steps of rotating the member about its axis and axially displacing the member relative to the die.

In another embodiment of the present invention, a die assembly for forming a member is disclosed to include a die having an upper portion and a lower portion cooperatively engageable with one another to define a die cavity and an ejector device coupled to the die to communicate with the cavity. The ejector device includes an ejector having an axis and twisting means for automatically rotating the ejector when the ejector is axially displaced relative to the die. A still further embodiment of the present invention includes a device for ejecting a member from a die wherein the device includes an ejector and twisting means for rotating the ejector relative to the nib when the ejector is axially displaced.

In still another embodiment of the present invention, the twisting device includes an ejector having a spiral groove extending radially inwardly from an exterior surface of the ejector for engaging a nib such that the ejector rotates upon axial displacement.

In yet another embodiment of the present invention, a formed member includes a body symmetric about its axis, a protrusion extending from the body, and a non-circular impression for rotationally coupling the formed member to an ejector device.

In yet another embodiment of the present invention, the twisting device includes an ejector having a spiral groove extending radially inward from an exterior surface of the ejector for engaging a nib such that the ejector rotates upon an axial displacement. The spiral groove having an angle with respect to the axis of rotation with a lower limit corresponding to the root cone angle of the gear being produced and an upper limit corresponding to the tooth angle of the gear being produced.

BRIEF DESCRIPTION OF THE DRAWINGS

FIG. 3*a* is a partial cross sectional view of an initial preforming station;

FIG. 3*b* is a partial cross sectional view of a secondary preforming station;

FIG. 3*c* is a partial cross sectional view of a finish forging station;

FIG. 4 is an axial end view of the forged gear shown in FIG. 1; and

DETAILED DESCRIPTION OF THE PREFERRED EMBODIMENT

While the following description and drawings illustrate the present invention for forging a gear having spiral teeth, such as a hypoid gear, those skilled in the art will appreciate that the device and method described and claimed herein is equally applicable for ejecting a variety of parts formed in a die. For simplicity, the terms "forging" and "gear" are used throughout the specification to refer not only to the specific types of manufacturing processes and parts illustrated and described herein but to all comparable processes for forming members having spiral or curved projections including members other than gears. The term "gear" thereby includes a member having a protrusion that is angled relative to the rest of the round or radiused part such as the cone described herein. Moreover, the gear can include a single protrusion or many protrusions all having the same angle of curvature pattern that may include a constant angle as well as an angle that changes as the protrusions proceed along the part. Accordingly, the following description of the embodiments of the present invention are merely exemplary in nature and not intended to unduly limit the scope of the invention as defined by the appended claims.

Figure 1:
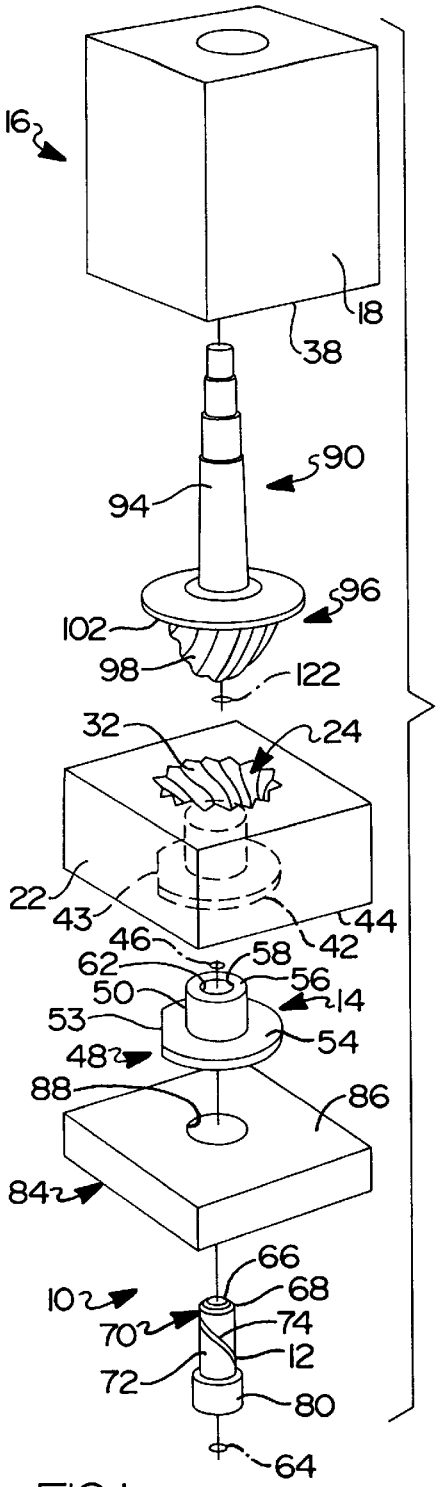
FIG. 1 is an exploded perspective view of a forging die and ejector assembly for forging and ejecting a gear having spiral teeth.
Figure 2:
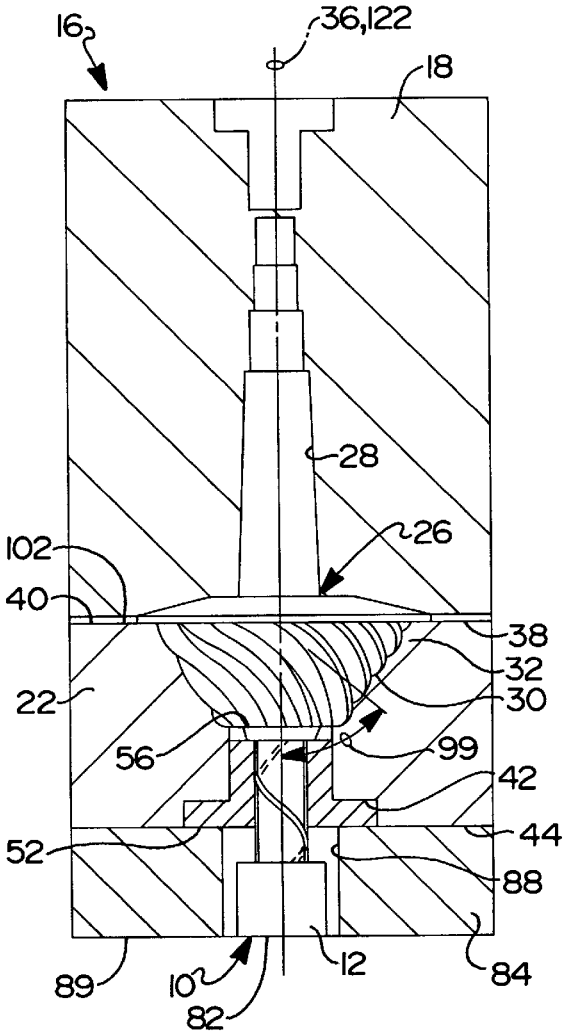
FIG. 2 is a partial cross sectional view of a finish forging station.
Figure 5:
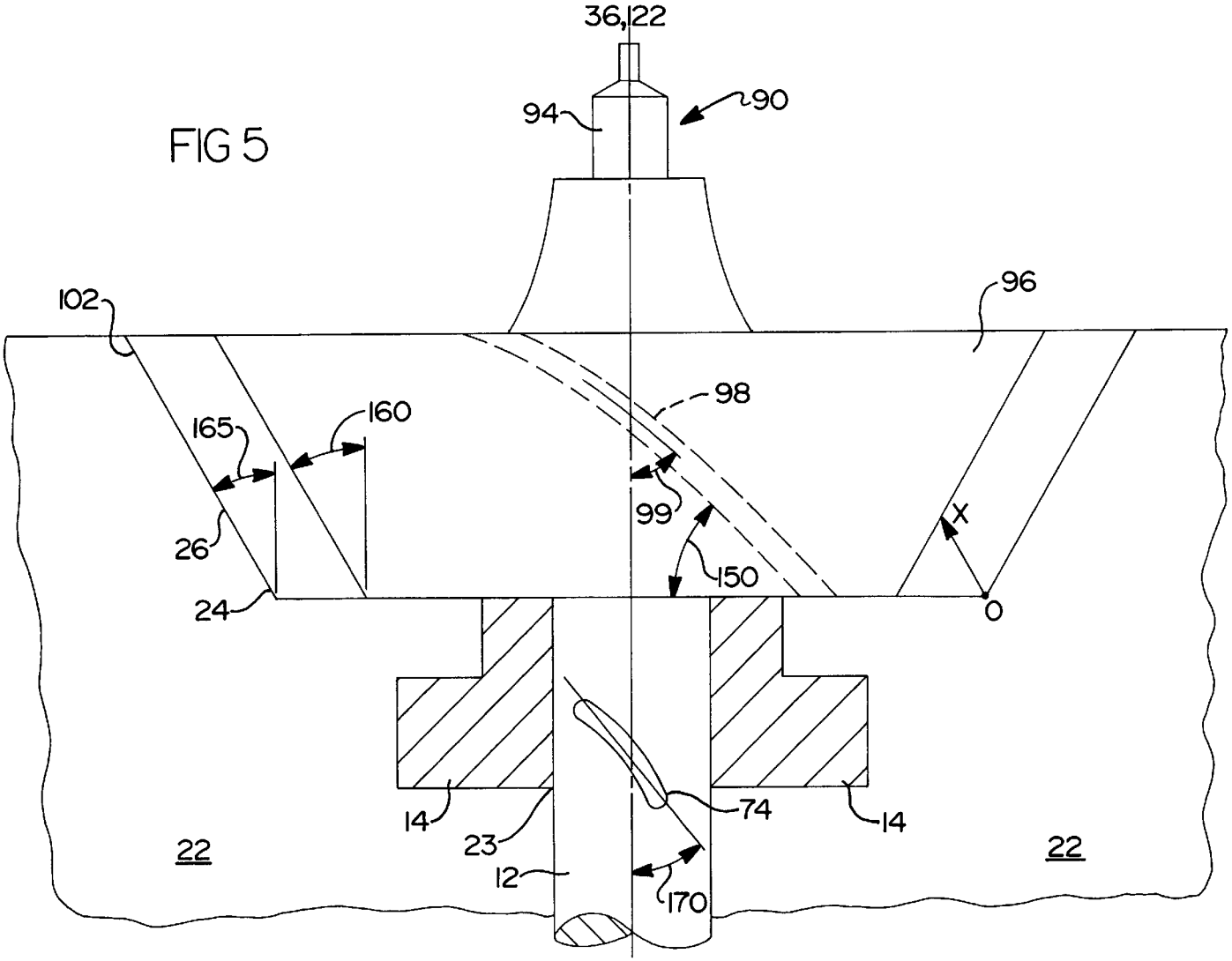
FIGS. 5*a–d* are partial cross sectional views of the forged gear and ejector assembly as shown in FIG. 1.

An ejector device 10 according to the present invention is illustrated in FIGS. 1, 2 and 5 to include an ejector 12 and a collar 14 configured to operate with a die 16 that includes an upper portion 18 defining an upper recess 20 and a lower portion 22 defining a lower recess 24. Those skilled in the art will appreciate that upper and lower recesses 20 and 24, respectively, cooperate to define a die cavity 26. While die 16 is configured to forge a hypoid gear as described in detail hereinafter, those skilled in the art will appreciate from this detailed description that ejector device 10 is operable with dies having a variety of cavity configurations.

The specific configuration of die cavity 26 includes a stem cavity 28 defined by upper recess 20 and a cone cavity 30 defined by lower recess 24. Lower recess 24 further includes a plurality of projections 32 extending inwardly into the cone cavity 30. In the illustrated embodiment, stem cavity 28 and cone cavity 30 are symmetric about a die axis 36. More particularly, stem cavity 28 decreases in cross section perpendicular to die axis 36 in a step-wise manner as cavity 28 extends away from an engagement surface 38 of upper die portion 18. Similarly, cone cavity 30 is generally conical in shape converging toward die axis 36 remote from an engagement surface 40 of lower die portion 28. Again, those skilled in the art will appreciate that while the specific configuration of die cavity 26 is described in some detail herein, the ejector device hereinafter described may be used with a variety of dies.

Lower die portion 22 further defines an ejector access port 42 extending from a lower surface 44 of lower die portion 22 to lower recess 24. Collar 14 is configured to be disposed within ejector access port 42 and coupled thereto in a manner hereinafter described. Collar 14, as best illustrated in FIG. 1, is generally symmetric about a collar axis 46 and includes a flange 48 and an upwardly extending hub 50. Flange 48 defines a lower flange surface 52 (FIG. 2) and an upper flange surface 54 from which hub 50 extends to terminate at an upper hub surface 56 contoured to define a surface of the formed part as hereinafter described. In one embodiment of the invention, a flat 53 formed on flange 48 cooperates with a corresponding flat 43 defined by port 42 to prevent rotation of collar 14 relative to die 16. Those skilled in the art will appreciate that any number of other techniques for restricting the rotation of collar 14 may be used without departing from the scope of the invention as defined by the appended claims. For example, the collar could be welded to the die, fixed thereto using a milled key slot, mechanically interlocked through a square headed collar and port, or fixed by dowelling.

An axially symmetrical opening 58 extends from lower flange surface 52 to upper hub surface 56 and is sized to accommodate ejector 12 in the manner hereinafter described. Collar 14 further includes a nib 62 extending radially inwardly into opening 58 from hub 50. Those skilled in the art will appreciate that while nib 62 is illustrated in the drawings as extending from collar 14, the collar may be eliminated whereupon nib 62 would extend directly from lower die portion 22 and into an appropriately configured passage therein. However, it is anticipated that collar 14 and ejector 12, described in detail hereinafter, are advantageously machined from a material such as hardened tool steel or die materials common to the die industry in order to provide the precision fit necessary therebetween. Accordingly, collar 14 is preferably included with ejector device 10 in order to facilitate the interchangeability of device 10 with a variety of dies.

As best illustrated in FIG. 1, ejector 12 is symmetric about an ejector axis 64 and includes a driver 66 extending axially from a first annular end of surface 68 at a first axial end 70 of the ejector. Ejector 12 also includes an outer cylindrical surface 72 from which a spiral groove 74 extends a predetermined distance radially inwardly. Ejector 12 further includes an actuating hub 80 extending radially outwardly from outer surface 72 and defining a contact surface 82 (FIG. 2).

Die 16 is further illustrated in the drawings to include a collar retention cap 84 having an upper surface 86 engaging lower surface 44 of lower die portion 22 and retaining collar 14 within ejector access port 42. Collar retention cap 84 further includes an ejector passage 88 extending from and between upper retention cap surface 86 and a lower retention cap surface 89. Numerous alternatives known in the art may be used to retain collar 14 access to port 42 without departing from the scope of the invention as defined by the appended claims.

With reference to FIG. 3*c*, ejector 12 is movable from and between a first position illustrated in the drawings by the solid lines to a second position shown in shadow and indicated by reference numeral 12'. In the first position, ejector 12 is retracted to allow the forging of the part as hereinafter described. Conversely, when moved to its second position, ejector 12 is axially and rotationally displaced through the cooperative engagement between nib 62 and spiral groove 74. This simultaneous axial and rotational movement is translated to the part via driver 66 whereby the part is rotated and urged away from lower die portion 22. Those skilled in the art will appreciate that upper die portion 18 is removed from engagement with lower die portion 22 prior to movement of ejector 12 into its second position. Those skilled in the art will also appreciate that while ejector 12 is shown coupled to lower die portion 22, the ejector could equally be coupled to upper die portion 18.

As stated above, the rotation of ejector 12 is accomplished through the cooperative engagement of nib 62 with spiral groove 74. Specifically, when ejector device 10 is assembled into its operative position relative to die 16, nib 62 is disposed within spiral groove 74 such that upon axial displacement of ejector 12 relative to lower die portion 22, nib 62 engages the ejector surfaces defining groove 74 thereby urging ejector 12 into rotational movement about its axis 64. The rotational movement of ejector 12 is transferred to the part through cooperative engagement of driver 66 and the part. Specifically, the part is formed within die cavity 26 and about driver 66 to define the cooperative engagement between the part and driver 66. As a result, as shown in FIG. 4, the finished part 90 includes an impression 92 corresponding to the shape of driver 66. While driver 66 is illustrated and described herein as being square in cross section, numerous non-circular shapes such as, for example, a diamond may be used without departing from the scope of the invention as defined by the appended claims.

As best illustrated in FIGS. 1 and 4, finished part 90 further includes a stem 94 integral with a cone 96 having spiral teeth 98 extending outwardly from a body 100 (FIG. 4). The complete forging of part 90 creates flash 102 between cone 96 and stem 94. More particularly, flash 102 is created in the finish forging step illustrated in FIGS. 2 and 3*c* as described hereinafter and insures that the upper portions of gear teeth 98 are completely formed and also prevents teeth 98 from being undesirably deformed during part removal, cooling, and material handling.

With reference to FIGS. 3*a*, 3*b*, and 3*c*, a method according to the present invention will be described. FIG. 3*a* shows an upper and lower die 104 and 106, respectively, for forming a pancake 108. Heating the billet creates oxidation or scale of the material to be forged. More particularly, as is generally understood by those skilled in the art, by forming the pancake, the surface tension between the pancake and the scale is broken which causes the scale to break off. This initial preform step is generally performed prior to the secondary preforming step illustrated in FIG. 3*b*.

As shown in FIG. 3*b*, secondary preforming includes placing the initial preform pancake 108 within a die cavity formed by upper and lower die portions 110 and 112, respectively. One or both of upper and lower dies 114 and 116 are then moved toward one another whereupon, in a manner generally known in the art, pancake 108 is deformed to form a blank 117 having a cone 118 and a stem 120 extruded to fill the cavity 110. Preformed blank 117 is thereupon removed from dies 114 and 116 and placed in die cavity 26 as heretofore described and illustrated in FIG. 3*c*. Upper and lower die portions 18 and 22 are placed in forging engagement whereupon they are forced together thereby more precisely forming stem 94 and cone 96 as well as teeth 98 thereof. It should be appreciated that preformed blank 117 can have partial teeth formed therein whereupon one or several impacts or hits during the final forming process illustrated in FIG. 3 forms the final teeth configuration of part 90.

The process of removing part 90 from die 16 according to the present invention includes retracting upper and lower die portions 18 and 22 from one another followed by the rotation and axial displacement of the part. Those skilled in the art will appreciate from this description that the rate of rotation of part 90 relative to its axial displacement is dictated by the tooth angle 99 of the spiral gear teeth 98 and root cone angle 160 of the gear cone relative to a plane extending along part axis 122 (FIG. 2). As previously discussed, part 90 can include a single or multiple teeth 98 each having the same angle of curvature patterns that can include a constant angle as well as an angle that changes as the tooth proceeds along the part. More particularly, the rate of rotation for ejection is calculated by considering the type of cavity and tooth form required. For example, straight toothed members such as bevel, miter, and spur gears need no rotation during ejection because there is no ejection load created between the tooth cavity in die 16 and the part during release. However, when an angled or curved tooth form is present in the cavity, the part is subjected during ejection to a load that tends to cause deformation of the teeth. This load or ejection pressure increases with the severity of the tooth angle 99. By imparting torque to part 90 via driver 66, the teeth 98 on part 90 are not subjected to the deformation forces created during vertical ejection. Specifically, the present invention significantly reduces or eliminates the pressures between the die and the leading surface of the tooth that are generated during vertical ejection thereby also eliminating the distortion, drag, and damage to the teeth associated with generally recognized release techniques.

The benefits of the present invention are particularly apparent when forming a spiral toothed member having severely angled teeth, i.e., tooth angles relative to the member body exceeding thirty (30°) degrees. However, the invention is useful for forming members wherein the angle of the spiral teeth is in the range of approximately ten (10°) degrees to seventy (70°) degrees. The present invention may also be used to form and/or eject parts having spiral projections angled in excess of seventy (70°) degrees. In these higher ranges of tooth angle, it may be desirable to utilize a rotary motor (not shown) to drive the ejector. Thus, those skilled in the art will appreciate that the apparatus and method according to the present invention may be used with teeth angles of various degrees as well as members having other types of angled projections.

As previously described in FIG. 2, FIG. 5 depicts a typical automotive drive pinion 90 in the lower portion of a die 22, known in the industry as a 35° drive pinion 90. As depicted, the bottom of the gear 90 is perpendicular to the ejector 12. Ejector 12 rotates and raises the gear 90 defining an ejection angle 170. The gear 90 has a tooth angle 99 of 55° (the complement of 35° 150 equaling 90° in the gear drive). The gear 90 further has a root cone angle 160 and face cone angle 165 which are approximately 26°. The cone angles 160, 165 are themselves natural draft release angles sufficient to release the gear 90 from a given cavity 22, if the gear 90 were to have straight teeth or no teeth. To allow ejection of the gear 90 from the bottom up through cavity 22, when the gear teeth 98 are angled or spiraled, a rotation means 23 must be added to the ejector 12. The rotation means 23, can take the form of an angled slot 74 in the ejector 12 coupled to a fixed pin 62, or alternatively a gearing mechanism may be utilized to spin the ejector 12 and simultaneously the gear 90 a given twist angle 180.

Advantageously, it has been found, however, that the rotation ejection angle 170, that is the angle the gear 90 is rotated about its axis 122 as well as the twist angle 180, can be less than the gear tooth angle 99 by considering the special geometries involved in the root cone angle 160 and face cone angles 165 in combination with the gear teeth angle 150.

Referring again to FIG. 5, point O at the instant of ejector 12 motion, the geometry of the toothed cone 96 in the cavity 22 allows for numerous combinations of angled, rotated and ejection angles 170. These angles are determined by a window of angles greater than the root cone angle 160 and face cone angles 165 in most cases and less than the teeth angle 150. In the illustrated example, the angle of rotation can be between 26° (from the root cone angle 160) and 55° (the tooth angle 99). To further reduce mechanical loading on the ejector 12 itself, it is desirable to have the ejection angle 170 equal less than 45°. As can be seen for a situation where the tooth angle 99 is greater than 45°, it is now possible to provide a rotating ejector system 23 which has reduced loads on the ejector 12 and allows for upward rotation of the gear 90 without contact with the lower cavity 22. For example, in FIG. 5, a rotation angle of 370 was chosen as being safely between 26° and 55°. More particularly, it was chosen because it was between 26° and 45°.

Point X shows the minimum ejection height required for the gear 90 to attain complete freedom from the lower die cavity 22. As such, the slot 74 is designed to allow 20 proper rotation of the gear 90, and sufficient stroke of the ejector 12 to clear the threaded lower die 22. Additional rotation is not necessary beyond the point the teeth clear the die 22. Briefly referring to FIGS. 5*c* and 5*d*, an alternate embodiment is shown wherein the slot 74" in the ejector 12 has a rotation ejection angle 170" equal to the gear tooth angle 98. In yet another embodiment, the slot 74" in the ejector 21 has a rotation ejection angle 170Δ equal to the root cone angle 160 or the face cone angle 165. As can be seen in FIG. 5*b*, if desired, the slot 74Δ on the ejectior 12 can be angled such that it provides the proper rotation sufficient to disengage the teeth 98 from the lower die 22 and can alternatively have a second portion 75 for allowing vertical displacement of the gear 90 out of the lower die 22, once the teeth 98 have cleared the projections 32 of cavity 26.

As described above, the rotation and axial displacement of the gear 90 relative to the die 22 is preferably performed simultaneously through the vertical displacement of ejector 12.

In view of this description as well as the appended drawings and claims, those skilled in the art will appreciate that the present invention provides an apparatus and device for ejecting a member having spiral projections from a die. Among the advantages provided by this invention is the elimination of deformation caused by contact between the projections and the impressions in the die from which material has just been removed. Moreover, the present invention allows the more precise forming of the member thereby minimizing subsequent and more costly machining steps. Specifically, ejection techniques previously used in the art often times required removal of as much as one hundred percent (100%) of the tooth defining material from the member subsequent to the forming process. As a result of the present invention, no machining may be necessary for members having lesser protrusion angles and minimal machining, on the order of only five percent (5%) to ten percent (10%) of the tooth defining material, is required for members having more severely angled teeth. It is anticipated that the finished member will be machined, finish cut, lapped or ground in order to obtain the proper fit between the parts of the gear set in order to reduce noise generation during operation. However, even in these instances, the present invention reduces the amount of machining necessary by allowing the members to be formed with more precise and complete components. It will also be understood that the reduced need for machining provided by the present invention provides a stronger toothed member in addition to decreasing manufacturing costs.

The foregoing discussion discloses and describes merely exemplary embodiments of the present invention. One skilled in the art will readily recognize from such description, and from the accompanying drawings and claims, that various changes, modifications, and variations can be made therein without departing from the spirit and scope of the invention as defined by the following claims.

What is claimed is:

1. A method for ejecting a part from a die, said part having an axis of rotation, a root cone angle, and a tooth angle, said method comprising the steps of:

rotating said part about said axis of rotation;

simultaneously axially displacing said part relative to said die thereby defining an ejection angle;

said ejection angle being less than said tooth angle and greater than said root angle.

2. The method of claim 1 wherein the ejection angle is between 45° and the root angle.

3. The method of claim 2 wherein said die includes an upper portion and a lower portion cooperating to define a die cavity, said die further including an ejector device communicating with said die cavity and having means for rotationally coupling said ejector device to the part, said ejector device having a rotation means for rotating said ejector about said axis of rotation upon vertical displacement thereof whereby the steps of simultaneously rotating said part about said axis and axially displacing said part relative to said die are accomplished by vertically displacing said ejector device.

4. The method of claim 1 wherein said part includes a body and at least one gear tooth protruding from said body.

5. The method of claim 4 wherein said gear tooth is disposed at an angle of at least about ten (10°) degrees relative to a plane extending along said part axis of rotation.

6. The method of claim 4 wherein said gear tooth is disposed at an angle of at least about thirty degrees (30°) relative to a plane extending along said part axis of rotation.

7. The method of claim 4 wherein said gear tooth is disposed at an angle within the range of about ten degrees (10°) to about seventy (70°) degrees relative to a plane extending along said part axis of rotation.

8. The method of claim 4 wherein said gear tooth is disposed at an angle in excess of about seventy (70°) degrees relative to a plane extending along said part axis.

9. The method of claim 4 further comprising the steps of vertically displacing said part without rotation when said gear tooth have cleared said die.

10. A device for ejecting a part from a die, said part having a body with a root cone angle and at least one gear tooth extending from said body, said gear tooth having a tooth angle; said device including an ejector having an axis of rotation and a rotating means for rotating said ejector about said axis of rotation at a twist angle when said ejector is axially displaced, said twist angle having a value greater than said root angle and less than said tooth angle.

11. The device of claim 10 wherein said rotation means includes a spiral groove extending radially inwardly from an exterior surface of said ejector and a nib coupled to said die for engagement with said spiral groove whereby said ejector rotates relative to said nib when said ejector is axially displaced.

12. The device of claim 11 further including a collar having coupling means for connecting said collar to the die, said collar defining said nib.

13. The device of claim 11 wherein said ejector further includes a driver for rotationally coupling said ejector to the part.

14. The device of claim 13 wherein said ejector further includes a first axial end, said driver protruding from said first axial end.

15. The device of claim 14 wherein said driver is non-circular in cross section.

16. The device of claim 13 wherein said ejector further includes a straight groove extending from said spiral groove whereby said ejector rotates relative to said nib when said nib engages a wall of said ejector along said spiral groove while said ejector is axially displaced until said spiral projections are clear from said die and said nib engages another wall of said ejector along said straight groove such that said ejector is axially displaced while not being rotated.

17. The device of claim 11 wherein said ejector includes a cylindrical body having a first axial end and a second axial end and a driver coupled to said first axial end, said spiral groove extending radially inwardly from an outer surface of said cylindrical body.

18. A die assembly for forming a part having a root cone angle, at least one gear tooth having a tooth angle, comprising:

a die including an upper portion and a lower portion cooperatively engageable to define a die cavity; and an ejector device coupled to said die and communicating with said die cavity, said ejector device including an ejector having an axis of rotation and rotation means for rotating said ejector when said ejector is axially displaced relative to said die at an angle which is greater than said root angle of the part to be formed in said die and less than said tooth angle defined in said die cavity.

19. The die assembly of claim 18 wherein said ejector includes a cylindrical exterior surface, said rotation means includes a spiral groove formed in said exterior surface and a nib fixed to said die, said ejector positioned relative to said die such that said nib is disposed within said spiral groove to follow said spiral groove and cause rotation of said ejector upon axial displacement thereof.

20. The die assembly of claim 19 wherein said ejector device further includes a collar having coupling means for connecting said collar to one of said upper portion and lower portion of said die, said collar defining said nib.

21. The die assembly of claim 20 wherein said coupling means includes a die cap retaining said collar in coupling engagement with the one of said upper portion and lower portion of said die.

* * * * *

UNITED STATES PATENT AND TRADEMARK OFFICE

CERTIFICATE OF CORRECTION

PATENT NO. : 6,041,640

DATED : March 28, 2000

INVENTOR(S) : Terrance M. McInerney, et al.

It is certified that error appears in the above-identified patent and that said Letters Patent is hereby corrected as shown below:

Column 6, line 14, delete "cone".
Column 7, line 27, "370" should be --37°--.
Column 7, line 38, "74" " should be --74'--.
Column 7, line 39, "170" " should be --170'--.
Column 7, line 42, "170Δ" should be --170"--.
Column 7, line 44, "74Δ" should be --74"--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*